United States Patent [19]

Green

[11] 4,188,055

[45] Feb. 12, 1980

[54] DISPOSABLE SHOVEL TONGS

[76] Inventor: Martin Green, 480 McDermott Rd., Rockville Center, N.Y. 11570

[21] Appl. No.: 944,949

[22] Filed: Sep. 22, 1978

[51] Int. Cl.[2] ..... A47L 13/52

[52] U.S. Cl. ..... 294/1 R; 294/16; 15/257.6

[58] Field of Search ..... 294/1 R, 16, 28, 25, 294/19 R, 55, 33, 106; 15/257.1, 257.6; 119/1; 229/3.5

[56] References Cited

U.S. PATENT DOCUMENTS

| | | | |
|---|---|---|---|
| 3,841,684 | 10/1974 | Fleishman | 294/1 R |
| 3,848,906 | 11/1974 | Fleishman | 294/1 R |

*Primary Examiner*—James B. Marbert

[57] ABSTRACT

Disposable manual finger shielding bilateral shovel tongs for sanitary removal and disposal of obnoxious matter such as animal excrement or litter, in the form of a self interlocking unitary firm structural planar member of locally linearly foldable and stiffly bendable resilient disposable material, e.g. biodegradable paperboard, having reinforcing interfolded and interlocked coplanar panels generally providing a substantially rectangular, flat, two dimensional composite shape and finger insertion shielding external glove-like pockets, and which upon bending upon itself with the pockets on the resultant exterior constitutes a pair of generally inherently resilient and self-reinforcing manual shielding bilateral shovel tongs of structural and mechanical integrity and stability for the stated purpose; and a unitary precursor blank for making the same.

11 Claims, 9 Drawing Figures

DISPOSABLE SHOVEL TONGS

Figure 1:
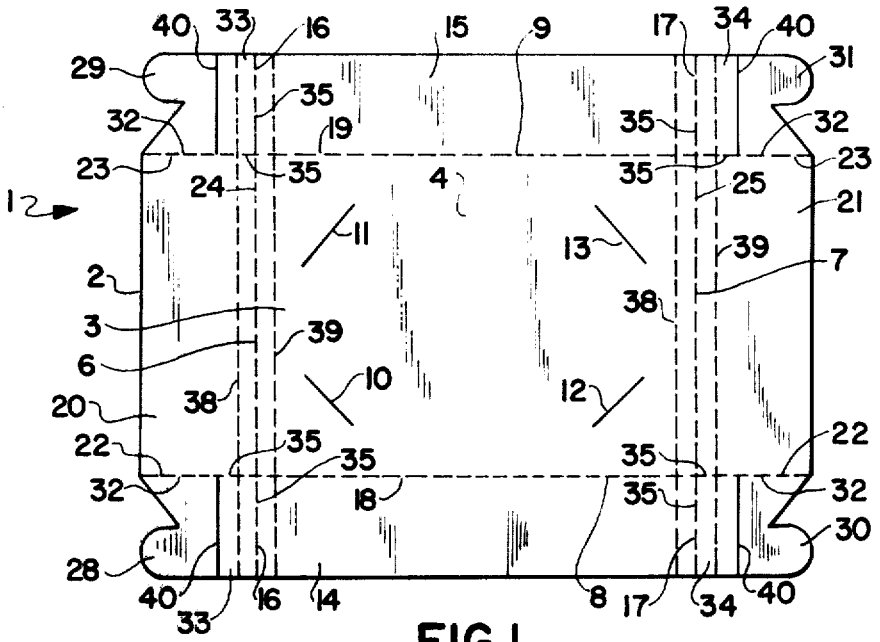

The present invention relates to disposable manual finger shielding shovel tongs for sanitary removal and disposal of obnoxious matter such as animal excrement or litter, and more particularly to such tongs in the form of a self-interlocking unitary firm structural planar member of disposable material having self reinforcing interfolded and interlocked coplanar panels and finger insertion shielding external pockets.

Many types of constructions have been provided heretofore for use in removing and disposing of obnoxious matter such as animal excrement or litter. Increasingly stricter enactment and enforcement of local city ordinances requiring pet owners to remove and dispose of the litter of their pets have created an increased demand for use of such constructions. However, to date these known constructions have either been comparatively complicated and costly to produce or have been difficult and awkward to use or manipulate, with resultant high continuing expense, inconvenience, incomplete or inadequate removal of the animal excrement, and more importantly insufficient protection against accidental finger contact with the litter.

In this regard, U.S. Pat. No. 3,676,887 to Klein covers a stiff envelope having an inlet blade end flap for unidirectionally scraping and scooping up animal litter and an adhesive layer along the envelope mouth to seal the contents upon such removal and after inwardly folding the inlet blade end flap into the envelope interior.

U.S. Pat. No. 3,857,597 to Young shows a similar device in the form of a pair of triangular box-like tongs for enclosing the litter in the three dimensional spatial closed tong interior.

U.S. Pat. No. 3,885,266 to Nafziger concerns a unidirectional scoop end flap-containing three dimensional spatial pyramidal box for the same purpose, while U.S. Pat. No. 3,995,807 To Dell' Anno provides a cognate unidirectional scoop end flap-containing three dimensional spatial rectangular box, whereas U.S. Pat. No. 3,971,503 to Allan et al contemplates a collapsible three dimensional spatial container likewise having a unidirectional scoop flat type closure.

U.S. Pat. No. 3,917,333 to Grattan utilizes a three-sided U-shaped open ended multi-foldable tubular member having an attached unidirectional scoop leaf forming the fourth side, such that upon scooping the litter contents into the open three dimensional spatial interior of the tubular member, the fourth side is folded in, and the composite is squeezed into a separate disposal bag.

U.S. Pat. No. 3,978,540 to Peck et al attaches a pair of stiff rearwardly extending scoop-like handles to opposed edges at the mouth of a disposal bag to force the litter thereinto after which the outer ends of the scoop-like handles are inwardly folded into the bag mouth to close the same.

None of the above known constructions provide for protection of the user against accidental finger contact with the litter and generally the same by their nature are either complicated and costly to produce, bulky due to their three dimensional spatial design and shape, or difficult and awkward to use or manipulate, if not inconvenient and inefficient, whether unidirectional or bilateral in functional purpose.

Although U.S. Pat. No. 3,685,088 to Doherty includes a separate freely disposed reversely extending short extra flap below the bottom of a typical three dimensional spatial rectangular scooplike box or pair of tongs similar to the aforesaid construction of U.S. Pat. No. 3,995,807 to Dell' Anno, which flap is intended to protect the fingers of the user during the scooping operation, there is little additional assurance that accidental finger contact with the litter will be avoided by such freely disposed short extra flap.

U.S. Pat. No. 3,850,467 to Johnson seeks to avoid the latter problem, by using a specially flared bag to enclose the entire arm of the user which has a slot at its inner or forward end through which a sheet scoop fixed thereat extends for picking up obnoxious soil material after which the end of the bag protecting the user's arm is brought forward over the exposed portion of the scoop and its precariously held contents to isolate the same. However, the result is only obtained by sacrificing simplicity and low cost in providing such a complex device.

U.S. Pat. No. 3,848,906 to Fleishman shows a rectangular cardboard monolayer panel centrally folded to form a pair of hinged tongs, in a manner completely destroying any resiliency at the hinge, and having infolded similar hinged end portions providing structurally weak unreinforced angular jaws for picking up animal excrement. This construction represents an extreme over-simplification of the box-like three dimensional spatial arrangements of the aforesaid constructions of U.S. Pat. Nos. 3,857,597 to Young, 3,917,333 to Grattan and to some extent 3,685,088 to Doherty, but is otherwise difficult to grasp and manipulate and is incapable of avoiding accidental finger contact with the litter as discussed above. U.S. Pat. No. 3,407,927 to Jones discloses nestable or stackable disposable tongs in the form of an elongate panel member or web, centrally bowed and having its ends folded back outwardly over the main web portion and secured thereto along the corresponding lateral sides thereof by adhesive where the web is made of paper or by heat sealing where the web is made of plastic, whereby to provide hygienic handling by the shopkeeper of articles such as unwrapped food or delicate cream cakes or pastries in shops. However, this construction is relatively supple and flimsy, and thus inherently wrinkle and crumple prone, lacking structural and mechanical integrity and stability, as it must be able to conform readily and without structural or mechanical resistance to the contours of the food articles being grasped by the fingers therethrough for assuring an adequate positive grip thereon to serve the necessary handling purposes.

It is among the objects and advantages of the present invention to overcome the above discussed drawbacks and deficiencies of the prior art constructions, and to provide disposable tongs for sanitary removal and disposal of obnoxious matter such as animal excrement or litter, which are inexpensive and simple to manufacture, easy to set up from blank planar material, convenient to use and manipulate, in a positive and forceful manner and with all necessary manual force and pressure, as well as efficient in removing the excrement or litter without danger of accidental finger contact with the obnoxious substance being removed, and furthermore which are composed of, preferably biodegradable, disposable material such as inexpensive, e.g. waste or recycled, paperboard.

It is among the additional objects and advantages of the present invention to provide tongs of the foregoing type in the form of a self-interlocking unitary firm structural planar member of preferably locally linerarly foldable yet stiffly bendable disposable material, having self-reinforcing interfolded and interlocked coplanar panels providing finger insertion shielding external glove-like pockets and stiff yet workable tong ends simultaneously forming corresponding coacting bilateral shovels for removing animal excrement or litter or other obnoxious matter regardless of its solid or pasty consistency.

It is among the further objects and advantages of the present invention to provide tongs of the stated type which may be set up rapidly from a unitary precursor blank into a unit of simple and compact or compactable, foldable form, essentially flat and two dimensional in spatial configuration, without the use of extraneous materials such as adhesives, glues, mechanical metal or plastic fasteners, rivets, staples or the like, by simple folding of various edge portions thereof onto itself, and in turn be safely used without fear of disassembling by reason of the presence of self-interlocking cooperating tab and insert slot elements therein which are preferably selectively positioned remote, both spatially and planarwise, from the tong outer edges and from the finger area portions of the pocket interiors.

It is among the further objects and advantages of the present invention to provide such tongs in the form of selectively dimensioned and positioned multi-layer planar panels in substantially immediate self reinforcing coplanar and protective disposition, possessing inherent resiliency and structural and mechanical integrity and stability for sturdy non-deflecting use under manual manipulating pick up pressure, and furthermore to provide the precursor blank per se for assembling the same into the unit as at the end point of use.

Figure 2:
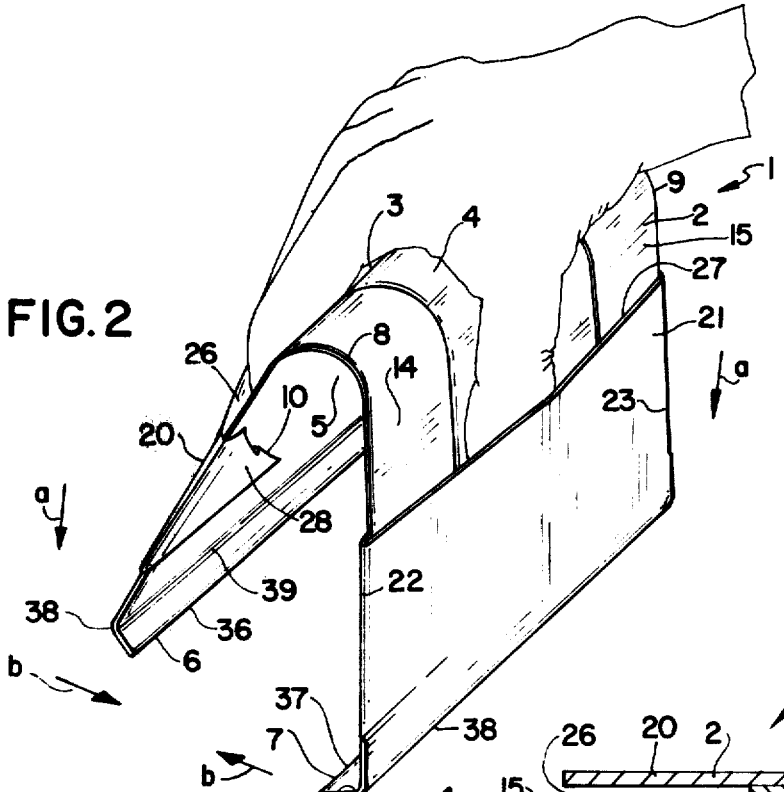
Figure 9:
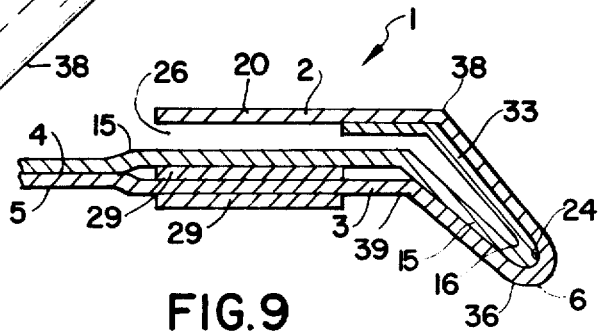
Figure 3:
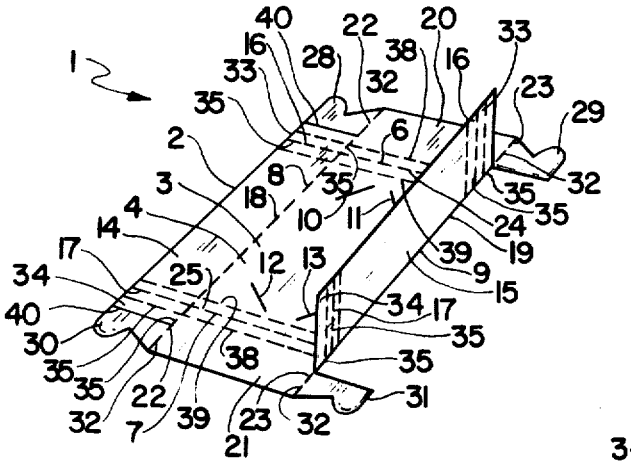
Figure 4:
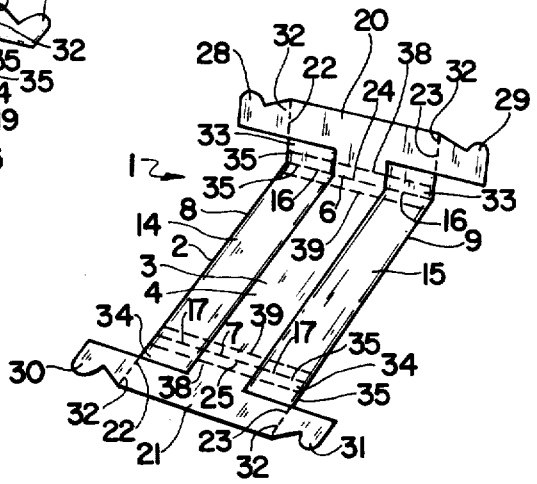
Figure 7:
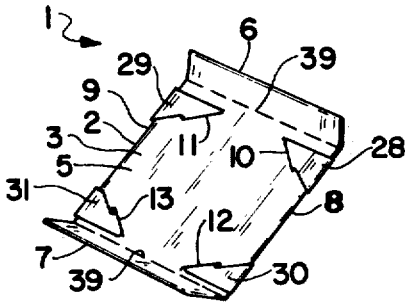
Figure 8:
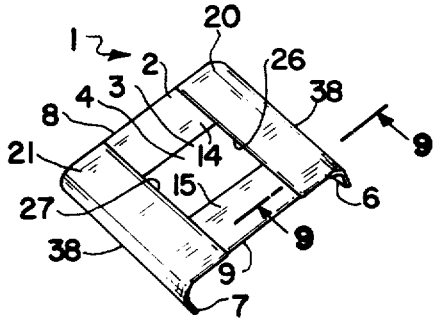

Other and further objects and advantages of the present invention will become apparent from a study of the within specification and accompanying drawings, in which:

FIG. 1 is a schematic plan view of a unitary precursor blank for forming the disposable tongs according to an embodiment of the invention, FIG. 2 is a schematic enlarged perspective view showing the manner in which the disposable tongs of the invention are usable, FIGS. 3 to 8 are schematic perspective views showing sequentially the manner of folding and setting up the precursor blank of FIG. 1 to form the disposable tongs of FIG. 2, and FIG. 9 is a schematic exaggerated enlarged sectional view taken along the line 9—9 of FIG. 8, illustrating the positional relationship of the various panels in self-reinforcing coplanar and protective disposition at one longitudinal end of the construction in the vicinity of the corresponding angularly bended tong jaw portion thereat.

According to the present invention, disposable manual finger shielding bilateral shovel tongs are advantageously provided which comprise a self-interlocking unitary firm structural planar member of preferably locally linearly foldable and stiffly bendable resilient disposable material. The unitary member includes a longitudinal main panel, a pair of opposed lateral panels and a pair of opposed end panels as well as enwrapping locking tabs for interlocking the various panel portions into a self-reinforced composite, snugly self-maintained, multi-layered pocket-containing structure.

The longitudinal main panel, e.g. of selective generally hand size dimensions, has top and bottom surfaces, opposed substantially transversely extending longitudinal ends, opposed substantially longitudinally extending lateral sides, and insert slots therethrough longitudinally inwardly of the longitudinal ends and preferably also transversely inwardly of the lateral sides.

The pair of opposed lateral panels constitute preferably transversely spaced apart substantially longitudinally extending lateral panels which extend substantially to the longitudinal ends of the main panel and which are joined to the main panel along the lateral sides of the main panel. The lateral panels are advantageously disposed in substantially coplanar disposition on the top surface of the main panel, especially in substantially protective covering relation over the insert slots in the main panel, and preferably transversely inwardly terminate in selectively spaced relation to each other, whereby to provide longitudinal reinforcement for the underlying portions thereat of the main panel, e.g. the marginal portions adjacent the lateral sides of the main panel, and conjoint protection at the insert slots.

The pair of opposed end panels constitute selectively longitudinally spaced apart substantially transversely extending end panels which extend to the lateral sides of the main panel and which are dimensioned to be thereby substantially transversely coextensive with the main panel. The end panels have opposed laterally outwardly facing sides and are joined to the main panel along the longitudinal ends of the main panel. They are disposed normally in substantially coplanar disposition on the top surface of the main panel and in generally confining and restraining overlying relation over the adjacent portions thereat of the lateral panels.

Advantageously, the end panels longitudinally inwardly terminate in selectively spaced relation to each other to provide suitable longitudinally opposed substantially transversely extending, normally closed yet manually distendable and openable, finger insertion shielding external glove-like pockets of selective dimensional depth in conjunction with the underlying marginal portions thereat of the main panel adjacent the longitudinal ends of the main panel.

The locking tabs constitute enwrapping reverse locking tabs which are joined to the laterally outwardly facing sides of the end panels and which are disposed in substantially coplanar disposition on the bottom surface of the main panel longitudinally inwardly of the longitudinal ends of the main panel. The locking tabs are advantageously arranged in protective interlocking relation with the insert slots in the main panel to maintain fixedly the resulting unitary composite in snug coplanar multi-layer disposition.

Thus, upon bending the unitary member upon itself with the pockets on the resultant exterior and the bottom surface of the main panel on the resultant interior, a pair of manual finger shielding bilateral shovel tongs is formed having sturdy jaws corresponding to the longitudinal ends of the main panel.

More specifically, the lateral panels and end panels are joined to the main panel and the locking tabs are joined to the end panels, advantageously, by corresponding integral linear fold interconnections appropriately therebetween. Significantly, as noted above, the lateral panels are disposed in protective covering relation over the insert slots in the main panel in the enfolded composite provided.

In accordance with a significant preferred feature of the present invention, the lateral panels which extend substantially to the longitudinal ends of the main panel are dimensioned to be thereby substantially longitudinally coextensive with the main panel, and are provided with opposed longitudinally outwardly facing ends. In this manner, opposed longitudinal end reverse extensions may be advantageously provided, which structurally extend longitudinally beyond the longitudinal ends of the main panel and transversely adjacent the laterally outwardly facing sides of the end panels, and which are joined to the longitudinally outwardly facing ends of the lateral panels and to the adjacent portions thereat of the laterally outwardly facing sides of the end panels.

Such reverse extensions in the enfolded composite unit are conveniently arranged longitudinally outwardly of the locking tabs, when the latter are in their interlocking relation with the insert slots, and in substantially coplanar interposed disposition between the lateral panels and end panels to provide advantageously additional longitudinal and transverse reinforcement for the longitudinal ends of the main panel at the pockets, and especially at the outer corners thereof.

In accordance with an especially preferred feature of the present invention, the marginal portions adjacent the longitudinal ends of the main panel and the corresponding adjacent portions of the lateral panels and end panels in substantially coplanar disposition thereat are angularly bended slightly along opposed corresponding common transverse bend lines in a direction toward the bottom surface of the main panel to form a pair of stiffly disposed and corner reinforced angled jaws thereat.

The unitary member is preferably advantageously provided in substantially rectangular planar shape and in compact, flat, two dimensional composite disposition, and may efficiently constitute locally linearly foldable and stiffly bendable yet firm substantially biodegradable paperboard or the like.

The unitary precursor blank form of the member in turn is advantageously provided with the necessary insert slots and locking tabs, and conveniently will preferably have fold lines, e.g. score lines or crimped lines or the like, defined therein corresponding to the linear boundaries along which the lateral panels and end panels are joined to the main panel and along which the locking tabs are joined to the end panels, as well as lateral transverse slits separating the adjacent portions of the locking tabs from the corresponding longitudinal end portions of the lateral panels thereat for ease in setting up the tongs unit.

Referring to the drawings, disposable manual finger shielding bilateral shovel tongs 1 (FIG. 2) are provided for sanitary removal and disposal of obnoxious matter such as animal excrement or litter or the like, constituting a self interlocking unitary firm structural planar member 2 of preferably locally linearly foldable yet stiffly bendable resilient disposable material, such as firm substantially biodegradable paperboard or the like type material, readily providable in inexpensive unitary precursor blank form (FIG. 1).

Member 2 includes a selectively dimensioned hand size longitudinal preferably substantially elongate rectangular main panel 3 having top surface 4 and bottom surface 5, opposed transversely extending longitudinal ends 6, 7, e.g. preferably spanning a distance corresponding to that between an arched thumb and middle finger (FIG. 2), opposed longitudinally extending lateral sides 8, 9, e.g. preferably spanning a distance corresponding to roughly one and a half to two times the width of the palm of a hand, and four spaced apart slanted insert slots 10, 11, 12, 13 therethrough opposite the corresponding corner portions of the main panel 3 and selectively arranged correspondingly longitudinally inwardly of the longitudinal ends 6, 7, and preferably also transversely inwardly of the lateral sides 8,9.

A pair of opposed transversely spaced apart longitudinally extending lateral panels 14, 15 extend substantially to the longitudinal ends 6, 7 of the main panel 3 and are selectively dimensioned to be thereby substantially longitudinally coextensive with the main panel 3. Lateral panels 14, 15 have opposed longitudinally outwardly facing ends 16, 16, 17, 17 and are joined by corresponding integral linear fold interconnections 18, 19 (FIG. 3) to the main panel 3 along the lateral sides 8, 9 of the main panel.

Lateral panels 14, 15 are advantageously disposed in substantially coplanar disposition on the top surface 4 of the main panel 3 (FIGS. 4, 5 and 8), and transversely inwardly terminate preferably in selective spaced relation to each other, yet will be disposed in protective covering relation over the insert slots 10, 11, 12, 13 in the main panel, whereby to provide not only coverage of the insert slots but also advantageous reinforcement for the underlying portions thereat of the main panel 3, e.g. the marginal portions adjacent to the lateral sides 8, 9 of the main panel (FIGS. 4, 5, 8 and 9).

Figure 5:
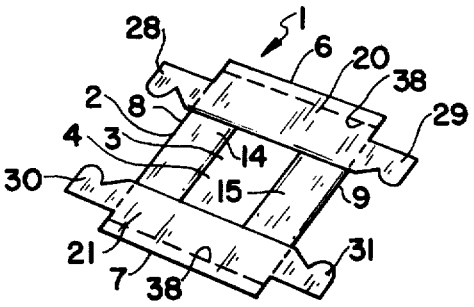
Figure 6:
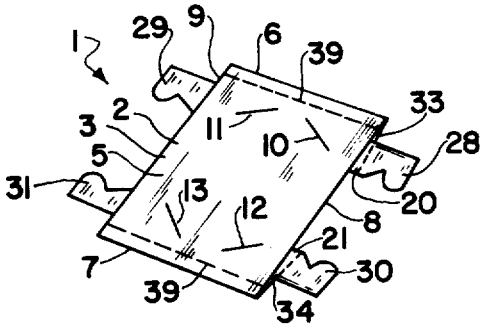

A pair of opposed selectively longitudinally spaced apart transversely extending end panels 20, 21 extend to the lateral sides 8, 9 of the main panel 3 and are selectively dimensioned to be thereby substantially transversely coextensive with the main panel. End panels 20, 21 have opposed laterally outwardly facing sides 22, 22, 23, 23 and are joined by corresponding integral linear fold interconnections 24, 25 to the main panel 3 along the longitudinal ends 6, 7 of the main panel. End panels 20, 21 are advantageously disposed normally in substantially coplanar disposition on the top surface 4 of the main panel 3 and in confining and restraining overlying relation over the adjacent portions thereat of the lateral panels 14, 15 (FIGS. 5 and 8).

End panels 20, 21 longitudinally inwardly terminate in selective spaced relation to each other to provide advantageous longitudinally opposed transversely extending, normally closed and manually distendable and openable, finger insertion shielding external glove-like pockets 26, 27 of selective individual depth dependent upon the respective width of the end panels, in conjunction with the underlying marginal portions thereat of the main panel 3 adjacent the longitudinal ends 6, 7 of the main panel. Pockets 26, 27 are preferably of uniform depth although non-uniform pockets may be used where end panels 20, 21 are of different selective widths.

Four opposed protective enwrapping reverse locking tabs 28, 29, 30, 31 are joined by corresponding linear fold interconnections 32, 32, 32, 32 to the corresponding laterally outwardly facing sides 22, 22, 23, 23 of the end panels 20, 21, and are advantageously disposed in substantially coplanar snug disposition on the bottom surface 5 of the main panel 3 longitudinally inwardly of the longitudinal ends 6, 7 of the main panel and are conveniently arranged in protective enwrapping interlocking relation with the corresponding insert slots 10, 11, 12, 13 therein (FIG. 7). The locking tabs suitably maintain fixedly the resulting unitary composite in snug coplanar multilayered disposition and advantageously substantially prevent relative movement of the panels in the direction of their planes.

Significantly, four opposed longitudinal end reverse extensions 33, 33, 34, 34 correspondingly extend longitudinally beyond the longitudinal ends 6, 7 of the main panel 3 and transversely adjacent the laterally outwardly facing sides 22, 22, 23, 23 of the end panels 20, 21, and are joined by corresponding integral linear fold interconnections 35, 35, 35, 35, to the longitudinally outwardly facing ends 16, 16, 17, 17 of the lateral panels 14, 14 and to the adjacent portions thereat of the laterally outwardly facing sides 22, 22, 23, 23 of the end panels 20, 21.

These reverse extensions 33, 33, 34, 34 are suitably arranged independently of as well as longitudinally outwardly of the locking tabs 28, 29, 30, 31, when the latter are in their interlocking relation with the insert slots 10, 11, 12, 13 (FIGS. 4, 5, 6 and 7), and are advantageously inherently in substantially coplanar interposed disposition between the lateral panels 14, 15 and end panels 20, 21 in their multi-layer enfolded and integrally interconnecting relation to provide additional longitudinal and transverse reinforcement for the longitudinal ends 6, 7 of the main panel 3 at the pockets 26, 27, and especially at the outer corners thereof (FIG. 9).

In this way, being in the form of such an interfolded and self enwrapped structural planar member or unit, e.g. of substantially rectangular composite flat, two dimensional planar shape (FIG. 8), the member 2 may be simply and readily bended upon itself, e.g. into a U-shaped or bowed configuration, with the pockets 26, 27 on the resultant exterior and the bottom surface 5 of the main panel 3 on the resultant exterior, whereby to form a resiliently acting pair of manual finger shielding bilateral shovel tongs 1 having jaws 36, 37 corresponding to the longitudinal ends 6, 7 of the main panel (FIG. 2).

By further angularly bending slightly the marginal portions adjacent the longitudinal ends 6,7 of the main panel 3 and the corresponding adjacent portions of the lateral panels 14, 15 and end panels 20, 21 in substantially coplanar disposition thereat, e.g. along opposed corresponding common transverse bend lines 38, 38, 39, 39 equidistantly spaced from the appropriate linear boundaries therebetween defining fold interconnections 24, 25, and in a direction toward the bottom surface 5 of the main panel 3, the tongs may be advantageously provided with a pair of opposed multi-layer end reinforced angled jaws thereat (FIG. 9).

It will be noted in this regard that the insert slots and locking tabs are located sufficiently inwardly of the jaws to avoid interference with the angular bending disposition of the jaws as well as unnecessary possible exposure of the immediate interior of the pockets at the insert slots to contamination as might occur were the slots to be located at the longitudinal ends 6, 7 of main panel 3 and the locking tabs accordingly repositioned thereat (FIG. 9), even though these tabs and slots are normally covered over by the lateral panels 14, 15.

Since the insert slots are longitudinally inward of the jaws and covered over by the lateral panels in relation to the interior of the pockets, it is less important that the insert slots also be located transversely inwardly of the lateral sides of the main panel. In fact, the locking tabs may even be cut to shorter transverse length (not shown) than the corresponding width of the lateral panels and the insert slots may in turn be located at or near the lateral sides of the main panel to accommodate them since this will remove such slots even further from the immediate finger area of the interior of the pockets without sacrificing adequate enwrapping locking tab interconnecting structural integrity and stability thereat, especially considering the ever present added protection of the lateral panels covering over these portions of the interior of the pockets.

Naturally, the width of the lateral panels may be concordantly increased in relation to the transverse inward location of the insert slots in the main panel for added protection of the interior of the pockets as well as for conjoint increase in transverse reinforcement of the main panel and jaws, although it is generally not necessary for such lateral panels to abut or overlap medially in transverse direction for achieving such basic purposes. Same size tabs with longer slot insert end portions, or shorter tabs, may be provided (not shown) for concordant use therewith, as the artisan will appreciate.

The precursor blank form of unitary member 2 (FIG. 1) may be suitably fabricated in precut shape or pattern of selective dimensions suitable for accommodating a user's hand, in conventional manner in a minimum step uncomplicated operation using relatively cheap paperboard or the like, especially recycled or reclaimed paperboard, which is preferably if not inherently biodegradable. The unitary precursor blank is suitably provided, e.g. by conventional machine punching or cutting technique, or even by manual cutting with a pair of scissors, with angularly positioned internal slits therethrough defining insert slots 10, 11, 12, 13, and with locking tabs 28, 29, 30, 31, as well as with lateral transverse slits 40, 40, 40, 40 separating the adjacent portions of the locking tabs from the corresponding reverse extensions 33, 33, 34, 34 and the longitudinal end portions of the lateral panels 14, 15 thereat.

Desirably, fold lines may be suitably defined in the blank corresponding to the linear boundaries along which the lateral panels 14, 15 and end panels 20, 21 are joined to the main panel 3, i.e. at 18, 19 and 24,25 respectively, the locking tabs 28, 29, 30, 31 are joined to the end panels, i.e. at 32, 32, 32, 32, and the reverse extensions 33, 33, 34, 34 are joined both to the lateral panels and to the end panels, i.e. at 35, 35, 35, 35. In this same regard, similar bend lines 38, 38, 39, 39, may also be suitably defined in the blank where opposed angled jaws are to be fashioned in the finished composite member 2 for providing the ultimate pair of tongs 1.

Such fold lines and bend lines may be provided as simple pencil or ink guide line indicia, physically cut or crimped score lines, or the like, as the artisan will appreciate.

Advantageously, the material constituting the blank is readily locally linearly foldable yet sufficiently firm so as to be stiffly bendable in multi-folded or multi-layered composite condition when set up as the self-interlocking member 2, whereby to hold its angular bend at the angled jaws and more especially to permit resilient resistance to the bowing action of the user constantly tending to open the jaws, i.e. when the member 2 is bended upon itself to form the tongs.

The presence of the lateral panels in relatively tight coplanar reinforcing relation on the lateral side portions of the main panel longitudinally coextensive therewith, simultaneously stabilizes advantageously any tendency of the main panel to buckle or yaw out of substantially normal bowed or U-shaped disposition during use of the tongs.

Moreover, the enwrapping relation of the end panels and conjoint reversely disposed locking tabs snugly inserted in the insert slots similarly structurally and mechanically stabilizes advantageously any such tendency of the main panel to buckle or yaw during use of the tongs, and serves to maintain the pockets in continuous protecting disposition over the user's fingers for facile, safe and positive closing and opening of the jaws by appropriate finger manipulation, i.e. urging inwardly against the main panel portions thereat or outwardly against the end panel portions thereat as the case may be.

In particular, due to the presence of the multi-folded or multi-layered composite condition at the jaws (FIG. 9), especially in view of the reverse extensions 33, 33, 34, 34 integrally connected both to the lateral panels and end panels, e.g. at least at the corresponding corner portions, enhanced reinforcement will be provided for added stabilizing of the desirably uniformly resiliently bowed or U-shaped disposition of the parts throughout and of the desirably angular disposition and straight edge conformation of the angled jaws.

Thus, the tongs 1 (FIG. 2) may be manually forced downwardly in the direction of the arrows a against the surface on which the obnoxious matter such as animal excrement or litter (not shown) is located with all necessary pressure for shoveling and/or scraping or scooping up the litter, and then forced inwardly in the direction of the arrows b, similarly with all necessary pressure, while still in contact with such surface for grasping, lifting and removing the litter for depositing into a waste or used paper bag or other inexpensive discardable closable container or wrapper, which itself may be readily disposed of in that substantially isolated form, or where permitted even for depositing into a sewer grating or the like.

The various manual manipulations can therefore be carried out by the user, both unidirectionally and bilaterally using one or both jaws as the case may be, without fear of accidental contact of the fingers with the animal excrement, soil or other litter sought to be removed from a given surface, such as the ground or city street, regardless of the solid or relatively pasty consistency of the obnoxious matter being removed and of the particular curved, angular, horizontal or vertical contour or spatial orientation of such surface.

The fingers of the user will be able sufficiently to sense the mass of material being removed by safe, confident, indirect touch through the protecting main panel paperboard or the like surface at the underside of the finger shielding glove-like pockets, yet the jaws will remain sufficiently stiff at the corners and along their straight edge portions to insure positive shoveling and/or scraping action at the corners and along the full width of the tongs for comparatively complete gathering of the litter and conjoint grasping, lifting and removing of the gathered litter from the surface, in a single manipulation or in repeated manipulations as and if necessary, yet in precise, rapid, positive and effective overall manner.

Should the hand inadvertently start to slip out of the pockets of the unit, slight pressure exerted on the jaws against the surface is all that is needed, for safe glove-like reinsertion of the hand fully into the pockets.

It will be realized that the longitudinal dimension of the main panel 3 and thus of the unit will be such that the bowed unit will be readily grasped by the hand in the manner shown in FIG. 2 with the thumb deeply inserted in one pocket and the remaining fingers correspondingly inserted in the other pocket for full control of the tong movement and shovel jaw guidance, whereas the transverse dimension thereof will be such that the corners of the pockets at the jaws will preferably extend laterally beyond the normal width of the hand, not only to allow room for distending the pockets as the hand is inserted, but also to provide an adequate workable width straight edge at the jaws for the necessary purposes as well as sufficient transverse protective distance between the pocket corners, longitudinally outwardly of the enwrapping locking tabs, and the nearest fingers laterally adjacent thereto.

Of course, as the artisan will appreciate, rather than provide the precursor blank in a variety of individual finger length sizes, one or more additional sets of insert slots (not shown) may be provided on one jaw side, e.g. medially longitudinally inwardly of the set of slots 12, 13 corresponding to the thumb pocket jaw side (FIG. 2), preferably along with concordant sets of fold lines at that side, for inward folding of end panel 21, for instance, to adjust the longitudinal distance between the longitudinal ends 6,7 of the main panel 3 to accommodate more precisely the spanning distance between the arched thumb and middle finger of the particular user's hand.

Understandably, the tongs after use will readily fit into a typical waste or used brown or kraft paper bag or the like along with the removed litter, although if necessary the used tongs may be easily transversely creased at the bowed portion thereof and then along the central longitudinal axis at the middle portion of the top surface 4 of the main panel 3 which is safely remote from the jaws, in order to condense the planar size of the unit to accommodate controlled, safe insertion into a small size bag or the like. In this manner, sanitary removal and disposal of the litter can be safely, conveniently and efficiently carried out.

It will be appreciated from the foregoing that the bendable disposable material, such as biodegradable paperboard, of which member 2 is made, must not merely be locally linearly foldable as is true of inherently relatively thin paper. Instead, it must be stiffly bendable as well, inherently unlike paper, to enable it to retain its desired structural and mechanically resistant stable coplanar multi-folded or multi-layered composite condition, especially along the full width of the jaws, and despite the presence of the user's fingers in the glove-like pockets, for positive, rapid and reliable shoveling, scraping, scooping, grasping, lifting and removing of the obnoxious litter. Such results and efficiency are, of course, not attainable with the use of inherently wrinkle and crumple prone paper constructions.

On the other hand, the bendable material must not be excessively stiff as would be the case with relatively thick waste cardboard, since the same usually will inherently uncontrollably crack apart undesirably along the fold lines, and perhaps expose the fingers of the user to accidental contact with the litter, yet in any case the same will form a composite interfolded member of unwieldy massive thickness especially at the corner portions of the jaws, preventing its use in the intended manner. More important is the fact that relatively thick cardboard, as opposed to paperboard, does not normally possess sufficient inherent resiliency permitting it to be bowed into U-shaped or tong configuration in a manner enabling the tong jaws to be repeatedly worked inwardly and outwardly as is possible with paperboard or the like type tongs as contemplated by the present invention.

Instead, it is well-recognized that, while paperboard and the like type materials are inherently resilient and foldable, cardboard and the like type materials generally crack when folded and permanently crease when bowed in a manner unduly destroying any reserve resiliency in the creased juncture area between the adjacent planar portions of the cardboard.

Hence, the locally linearly foldable and stiff bendable material contemplated by the present invention suitably possesses inherent resiliency for distributing its reserve resilient counterforce to bending more or less uniformly and stably along the extent of the bend, yet remains sufficiently stiff both to preserve its original or natural planar structural and mechanical integrity and stability without wrinkling or crumpling and also to provide corresponding structural and mechanically resistant and stable folded straight edge portions constituting the tong jaws.

From the foregoing, it is clear that the construction of the present invention is simple and compact in design, being essentially flat and two dimensional in spatial configuration, inexpensive to fabricate, easy to set up, as well as convenient to use and manipulate, both unidirectionally and bilaterally, in a positive and forceful manner and with all necessary force and pressure for relatively complete removal of animal excrement or other obnoxious material of varying solid to pasty consistency, without fear of accidental finger contact with the obnoxious material. No extraneous adhesives, glues, mechanical metal, plastic or other fasteners, rivets, staples, etc. are needed, and the unitary precursor blanks may be inexpensively fabricated and merchandised in commercial quantities from cheap or waste or recycled bendable disposable material, for individual folding to set up the self interlocking member or tongs unit by the purchasing pet owner or other user, such as while walking the pet. Of course, suitable waste or recycled brown or kraft or other relatively cheap paper or plastic bags or containers may be sold along with the precursor blanks for receiving the litter as well as the used member or tongs unit, due to its inherently compact or compactable, foldable form, for ultimate disposal conveniently during the same pet walking excursion.

Thus, as may be appreciated from the foregoing, the disposable manual shielding shovel tongs of the present invention broadly contemplate a self-interlocking unitary or one-piece firm structural planar member of stiffly bendable disposable material, generally including a longitudinal main panel, e.g. having top and bottom surfaces, opposed substantially transversely extending longitudinal ends and opposed substantially longitudinally extending lateral sides; a pair of opposed substantially longitudinally extending lateral panels, e.g. preferably substantially longitudinally coextensive with the main panel, which are joined to the main panel along the lateral sides of the main panel and disposed in substantially coplanar disposition on the top surface of the main panel to provide longitudinal reinforcement for the underlying portions thereat of the main panel; and a pair of opposed longitudinally spaced apart substantially transversely extending end panels, e.g. dimensioned to be substantially transversely coextensive with the main panel, which are joined to the main panel along the longitudinal ends of the main panel and disposed normally in substantially coplanar disposition on the top surface of the main panel and in overlying relation over the adjacent portions thereat of the lateral panels and which longitudinally inwardly terminate in spaced relation to each other to provide longitudinally opposed substantially transversely extending, normally closed and manually distendable and openable, finger insertion shielding external pockets in conjunction with the underlying marginal portions thereat of the main panel adjacent the longitudinal ends of the main panel; with coacting locking tabs and insert slots being selectively positioned on the member and arranged in interlocking relation for self-interlocking the panels into a corresponding self-reinforced composite, snug self-maintained multi-layer pocket-containing structure. Hence, upon bending the unitary member upon itself with the pockets on the resultant exterior and the bottom surface of the main panel on the resultant interior, the pair of manual shielding shovel tongs will be desirably formed having jaws corresponding to the longitudinal ends of the main panel.

It will be appreciated that the instant specification and drawings are set forth by way of illustration and not limitation, and that various modifications and changes may be made therein without departing from the spirit and scope of the present invention which is to be limited solely by the scope of the appended claims.

What is claimed is:

1. Disposable manual shielding shovel tongs comprising a self interlocking unitary firm structural planar member of stiffly bendable disposable material including a longitudinal main panel having top and bottom surfaces, opposed substantially transversely extending longitudinal ends, opposed substantially longitudinally extending lateral sides, and insert slots therethrough longitudinally inwardly of the longitudinal ends, a pair of opposed substantially longitudinally extending lateral panels extending substantially to the longitudinal ends of the main panel and joined to the main panel along the lateral sides of the main panel and disposed in substantially coplanar disposition on the top surface of the main panel to provide longitudinal reinforcement for the underlying portions thereat of the main panel, a pair of opposed longitudinally spaced apart substantially transversely extending end panels extending to the lateral sides of the main panel and dimensioned to be thereby substantially transversely coextensive with the main panel and having opposed laterally outwardly facing sides and joined to the main panel along the longitudinal ends of the main panel and disposed normally in substantially coplanar disposition on the top surface of the main panel and in overlying relation over the adjacent portions thereat of the lateral panels and longitudinally inwardly terminating in spaced relation to each other to provide longitudinally opposed substantially transversely extending, normally closed and manually distendable and openable, finger insertion shielding external pockets in conjunction with the underlying marginal portions thereat of the main panel adjacent the longitudinal ends of the main panel, and reverse locking tabs joined to the laterally outwardly facing sides of the end panels and disposed in substantially coplanar disposition on the bottom surface of the main panel longitudinally inwardly of the longitudinal ends of the main panel and arranged in interlocking relation with the insert slots therein, whereby upon bending the member upon itself with the pockets on the resultant exterior and the bottom surface of the main panel on the resultant interior, a pair of manual shielding shovel tongs is formed having jaws corresponding to the longitudinal ends of the main panel.

2. Tongs according to claim 1 wherein the lateral panels and end panels are joined to the main panel and the locking tabs are joined to the end panels by corresponding integral linear fold interconnections therebetween, and the lateral panels are disposed in substantially protective covering relation over the insert slots in the main panel.

3. Tongs according to claim 1 wherein the lateral panels extending substantially to the longitudinal ends of the main panel are dimensioned to be thereby substantially longitudinally coextensive with the main panel and are provided with opposed longitudinally outwardly facing ends, and opposed longitudinal end reverse extensions, extending longitudinally beyond the longitudinal ends of the main panel and transversely adjacent the laterally outwardly facing sides of the end panels, are joined to the longitudinally outwardly facing ends of the lateral panels and to the adjacent portions thereat of the laterally outwardly facing sides of the end panels and are arranged longitudinally outwardly of the locking tabs when in their interlocking relation with the insert slots and in substantially coplanar disposition between the lateral panels and end panels to provide additional longitudinal and transverse reinforcement for the longitudinal ends of the main panel at the pockets.

4. Tongs according to claim 1 wherein the marginal portions adjacent the longitudinal ends of the main panel and the corresponding adjacent portions of the lateral panels and end panels in substantially coplanar disposition thereat are angularly bended slightly along corresponding common transverse bend lines in a direction toward the bottom surface of the main panel to form a pair of angled jaws thereat.

5. Tongs according to claim 1 wherein the member is substantially rectangular in planar shape and comprises locally linearly foldable stiffly bendable firm substantially, biodegradable paperboard.

6. Tongs according to claim 1 in the form of a precursor blank provided with such insert slots and locking tabs and having fold lines defined therein corresponding to the linear boundaries along which the lateral panels and end panels are joined to the main panel and the locking tabs are joined to the end panels, and further provided with lateral transverse slits separating the adjacent portions of the locking tabs from the corresponding longitudinal end portions of the lateral panels thereat.

7. Disposable manual shielding shovel tongs according to claim 1 comprising a self interlocking unitary firm structural planar member of locally linearly foldable stiffly bendable resilient disposable material including a longitudinal substantially rectangular main panel having top and bottom surfaces, opposed transversely extending longitudinal ends, opposed longitudinally extending lateral sides, and four spaced apart insert slots therethrough arranged correspondingly longitudinally inwardly of the longitudinal ends and transversely inwardly of the lateral sides, a pair of opposed transversely spaced apart longitudinally extending lateral panels extending substantially to the longitudinal ends of the main panel and dimensioned to be thereby substantially longitudinally coextensive with the main panel and having opposed longitudinally outwardly facing ends and joined by corresponding integral linear fold interconnections to the main panel along the lateral sides of the main panel and disposed in substantially coplanar disposition on the top surface of the main panel and in substantially protective covering relation over the insert slots and transversely inwardly terminating in spaced relation to each other to provide longitudinal reinforcement for the underlying marginal portions thereat of the main panel adjacent to the lateral sides of the main panel, a pair of opposed longitudinally spaced apart transversely extending end panels extending to the lateral sides of the main panel and dimensioned to be thereby substantially transversely coextensive with the main panel and having opposed laterally outwardly facing sides and joined by corresponding integral linear fold interconnections to the main panel along the longitudinal ends of the main panel and disposed normally in substantial coplanar disposition on the top surface of the main panel and in confining overlying relation over the adjacent portions thereat of the lateral panels and longitudinally inwardly terminating in spaced relation to each other to provide longitudinally opposed transversely extending, normally closed and manually distendable and openable, finger insertion shielding external glove-like pockets in conjunction with the underlying marginal portions thereat of the main panel adjacent the longitudinal ends of the main panel, four opposed reverse locking tabs joined by corresponding linear fold interconnections to the corresponding laterally outwardly facing sides of the end panels and disposed in substantially coplanar disposition on the bottom surface of the main panel longitudinally inwardly of the longitudinal ends of the main panel and arranged in enwrapping interlocking relation with the corresponding insert slots therein, and four opposed longitudinal end reverse extensions, correspondingly extending longitudinally beyond the longitudinal ends of the main panel and transversely adjacent the laterally outwardly facing sides of the end panels, joined by corresponding integral linear fold interconnecting to the longitudinally outwardly facing ends of the lateral panels and to the adjacent portions thereat of the laterally outwardly facing sides of the end panels and arranged independently of and longitudinally outwardly of the locking tabs when in their interlocking relation with the insert slots and in substantially coplanar interposed disposition between the lateral panels and end panels to provide additional longitudinal and transverse reinforcement for the longitudinal ends of the main panel at the pockets, whereby upon bending the member upon itself with the pockets on the resultant exterior and the bottom surface of the main panel on the resultant interior, a pair of manual shielding shovel tongs is formed having jaws corresponding to the longitudinal ends of the main panel.

8. Tongs according to claim 7 wherein the marginal portions adjacent the longitudinal ends of the main panel and the corresponding adjacent portions of the lateral panels and end panels in substantially coplanar disposition thereat are angularly bended slightly along opposed corresponding common transverse bend lines in a direction toward the bottom surface of the main panel to form a pair of multi-layer end reinforced angled jaws thereat.

9. Tongs according to claim 7 wherein the member is substantially rectangular in composite planar shape and comprises firm substantially biodegradable paperboard.

10. Tongs according to claim 7 in the form of a precursor blank provided with such insert slots and locking tabs and having fold lines defined therein corresponding to the linear boundaries along which the lateral panels and end panels are joined to the main panel, the locking tabs are joined to the end panels and the reverse extensions are joined to the lateral panels and to the end panels, and further provided with slits separating the adjacent portions of the locking tabs from the corresponding reverse extensions and longitudinal end portions of the lateral panels thereat.

11. Disposable manual shielding shovel tongs comprising a self interlocking unitary firm structural planar member of stiffly bendable disposable material including a longitudinal main panel having top and bottom surfaces, opposed substantially transversely extending longitudinal ends and opposed substantially longitudinally extending lateral sides, a pair of opposed substantially longitudinally extending lateral panels joined to the main panel along the lateral sides of the main panel and disposed in substantially coplanar disposition on the top surface of the main panel to provide longitudinal reinforcement for the underlying portions thereat of the main panel, a pair of opposed longitudinally spaced apart substantially transversely extending end panels dimensioned to be substantially transversely coextensive with the main panel and joined to the main panel along the longitudinal ends of the main panel and disposed normally in substantially coplanar disposition on the top surface of the main panel and in overlying relation over the adjacent portions thereat of the lateral panels and longitudinally inwardly terminating in spaced relation to each other to provide longitudinally opposed substantially transversely extending, normally closed and manually distendable and openable, finger insertion shielding external pockets in conjunction with the underlying marginal portions thereat of the main panel adjacent the longitudinal ends of the main panel, and coacting locking tabs and insert slots selectively positioned on the member and arranged in interlocking relation for self-interlocking the panels into a corresponding selfreinforced composite, snugly self-maintained, multi-layer pocketcontaining structure, whereby upon bending the member upon itself with the pockets on the resultant exterior and the bottom surface of the main panel on the resultant interior, a pair of manual shielding shovel tongs is formed having jaws corresponding to the longitudinal ends of the main panel.

* * * * *